United States Patent [19]

Wolfberg et al.

[11] Patent Number: 4,752,973

[45] Date of Patent: Jun. 28, 1988

[54] GLOVE

[76] Inventors: Larry B. Wolfberg; Carolyn A. Wolfberg, both of 4615 Kahala Ave., Honolulu, Hi. 96816

[21] Appl. No.: 70,630

[22] Filed: Jul. 7, 1987

Related U.S. Application Data

[63] Continuation of Ser. No. 859,317, May 5, 1986.

[51] Int. Cl.[4] ..... A41D 19/00

[52] U.S. Cl. ..... 2/163; 2/158; 2/169

[58] Field of Search ..... 2/163, 164, 167, 159, 2/158, 166, 275

[56] References Cited

U.S. PATENT DOCUMENTS

| | | | |
|---|---|---|---|
| 265,902 | 10/1882 | Whitaker | 2/169 |
| 595,925 | 12/1897 | Schrecker | 2/166 |
| 1,256,391 | 2/1918 | Taylor | 2/159 |
| 1,388,549 | 8/1921 | Carson | 2/166 |
| 1,468,791 | 9/1923 | Abraham et al. | 2/167 |
| 2,643,388 | 6/1953 | Curtis | 2/158 |
| 2,670,473 | 3/1954 | Stebic | 2/159 |
| 2,713,171 | 7/1955 | Talbot | 2/159 |
| 2,743,453 | 5/1956 | Singer | 2/158 |
| 4,104,740 | 8/1978 | Rinehart | 2/158 |
| 4,534,066 | 8/1985 | Hansson | 2/163 |
| 4,590,627 | 5/1986 | Connelley | 2/167 |

OTHER PUBLICATIONS

Butterick Pattern #3006, New York, N.Y. 10013, "Misses Basic Fitting Shell", 4 pages.

*Primary Examiner*—Louis K. Rimrodt
*Assistant Examiner*—J. L. Olds
*Attorney, Agent, or Firm*—Nixon & Vanderhye

[57] ABSTRACT

The hand covering, in the nature of a glove, is particularly intended for use by women in putting on and taking off panty hose, the glove being segmented into a plurality of sections, a first section enveloping the thumb, a second section enveloping the index finger and a third section enveloping the middle, ring and little fingers, the sections being joined at their base end, with a radius and a plurality of relief cuts being formed at the junction of each base end of the sections with one another, whereby maximum movement of the thumb and index finger is facilitated when the glove is donned and subsequently utilized in putting on and taking off panty hose, the material of the glove being nylon, whereby the user thereof may efficiently employ her fingers to guide, push, pull and grab the panty hose, or other hosiery, onto and over the foot, leg, hip and waist, while simultaneously positioning the seams of the hosiery without snagging or tearing the hosiery.

3 Claims, 1 Drawing Sheet

GLOVE

This is a continuation of application Ser. No. 859,317, filed May 5, 1986, now abandoned.

BACKGROUND OF THE INVENTION

1. Field of the Invention

A glove for use by women in putting on and taking off clothing items such as panty hose, hose and leotards, the glove being of a soft material such as nylon; segmented into a plurality of sections, there being a section for the thumb, a section for the index finger and a section for the remaining three fingers, the sections being joined at their base ends with a radius whereby maximum movement of the thumb and fingers of the user is permitted when the glove is on and the user is donning panty hose or other similar items of clothing or using the glove for other purposes.

2. Description of the Prior Art

Hand coverings in the nature of gloves, mittens, mitts and the like have long been known, as have hand coverings in the nature of gloves which are segmented to present a plurality of interconnected sections for collectively enveloping the thumb and four fingers of a user, with separate sections being provided for the thumb; for the index finger; and for the middle, ring and little finger.

Glove construction of this general type is taught by the following United States patents: Whitaker, U.S. Pat. No. 265,902; Abraham, U.S. Pat. No. 1,468,791; Curtis, U.S. Pat. No. 2,643,388; and Hansson, U.S. Pat. No. 4,534,066.

However, none of these patents disclose a glove of lightweight material, such as nylon, wherein the junctions between the base ends of the individual sections are provided with a radius, as contrasted to a sharp V-configurations, whereby the sections are interconnected to permit maximum movement of the thumb and index finger of the user when the glove is used for instance to work with delicate material such as hosiery, when it is necessary to position such hosiery on the body.

Yet further, the prior art does not teach, in combination with such a radius, a plurality of relief cuts radiating outwardly from each of the radii whereby to relieve the stress which is normally presented at the radii and to further enhance the moveability of the first and second sections of the glove and thus achieve the desired complete freedom of movement of the thumb and fingers when the glove is utilized in handling the placement of garments such as panty hose on the body, where maximum dexterity is needed. The glove disclosed herein may be fabricated from a nylon material and may present a metacarpal portion and a gauntlet portion whereby to cover the entire hand of the user, with elastic being provided between said portions to retain, position and hold the glove in the correct position on the hand of the user or, in the alternative, the glove may present an abbreviated metacarpal portion which terminates midway of the metacarpal area of the user whereby essentially only the thumb and finger enveloping sections are presented.

The glove finds particular usage in covering the hands of women when it is desired to put on items such as hose or panty hose but yet retain on the user's hands rings, which otherwise might have a tendency to rip, tear or snag the hosiery, the glove also preventing damage to the hosiery due to rough skin or jagged fingernails.

Thus, there is provided a lightweight, highly flexible, highly maneuverable glove, particularly intended to be utilized by a woman in placing panty hose on her body but which is also highly usable in other instances where protection or covering for the hand is desired while retaining maximum dexterity for the fingers, notwithstanding their envelopment in the glove. Other uses might include use as a protective glove to prevent special creams and medications from getting on bed linens, covers, and furniture or use as a cover for the hands when hand or machine washing delicate fabrics.

DESCRIPTION OF PREFERRED EMBODIMENT

Figure 3:
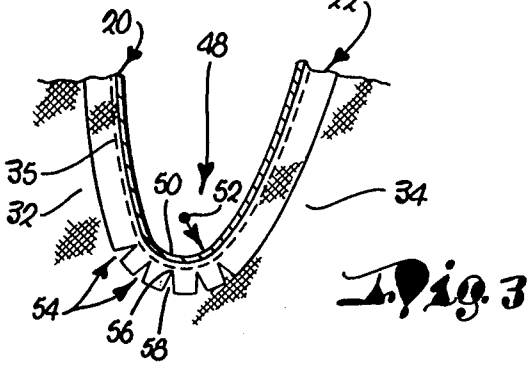
FIG. 3 is an enlarged fragmentary view showing the radius and the relief cuts at the junction between the second section and the third section of the glove and taken from the inside of the glove.

The hand covering in the nature of a glove is broadly designated by the numeral 10 and includes, as its basic components, in the embodiment illustrated in the drawings, a gauntlet portion 12; and a metacarpal portion 14, there being a band of elastic 16 between said portions 12 and 14.

Extending outwardly from the metacarpal portion 14, are a plurality of interconnected sections which collectively envelope the thumb and four fingers of the user of the glove 10. Specifically, these are a first section 18 which is intended to envelope the thumb of the user; a second section 20 which is intended to envelope the index finger of the user; and a third section 22 which is intended to envelope the remaining three fingers, namely, the middle finger, ring finger and little finger of the user of glove 10.

Each of the sections 18, 20 and 22 presents a tip end 24, 26 and 28, respectively, which tip ends 24, 26 and 28 are normally the outermost ends of the glove 10 and cover the fingernail portion of the finger of the user thereof.

Likewise, each of the sections 18, 20 and 22 presents a base end. The base end of section 18 is indicated broadly at 30; the base end of section 20 is indicated at 32; and the base end of section 22 is indicated at 34. The base ends 30, 32 and 34 are each joined with the metacarpal portion 14 of the glove 10 whereby to present the completed glove. The second section 20 and the third section 22 preferably each have an enlarged area from the base ends 32 and 34 thereof, extending to about the first joint of the fingers therein, in order to accommodate any rings worn on the fingers of the user of the glove 10.

It is contemplated that the glove will be made from a pair of identical halves or tranks, which are joined together as by overlaying the two tranks and then sewing the same along their mating edges whereby to complete fabrication of the glove 10. The stitching which would join the two halves or tranks together is shown as at 35 in FIGS. 2 and 3 and is preferably a chain stitch.

The glove 10 is ambidextrous; that is, a single, universal glove may be donned on either hand of a user merely be turning the glove over to align the sections thereof with the corresponding thumb and fingers of the user and then inserting the hand of the user in the glove. When this is done, the thumb is extended the full length of the first section 18; the index finger is extended the full length of section 20 and the remaining middle, ring and little fingers are encased in the remaining third section 22. The glove is then pulled down over the hand and, in the embodiment chosen for illustration, the elastic 16 retains the glove in position by virtue of its encirclement of the wrist of the user just below the metacarpal portion of the user's hand.

The elastic 16 is in the form of a band about ⅛" wide to provide optimum fit of the glove and to permit a universal fit for the glove. The band of elastic is held in place by suitable stitching to permit maximum expansion of the elastic band when donning and removing the glove but yet firmly retain the glove in position on the wearer's hand when in use.

In order to use the glove 10 for its intended purpose, as hereinabove referred to and which is for the taking on and putting off of panty hose or other hosiery, it is preferred that the glove be fabricated from a nylon material. It has been found that the best material is nylon of a fineness of from 40 to 70 denier, although it is apparent that other materials, either in the nature of cloth or additional plastic material may be utilized in fabricating the glove and still permit use thereof for the intended purpose. It has also been found that single size will fit most women's hands and thus it is only necessary to fabricate a glove in a single shape of a single size whereby to essentially provide a hand covering for all potential users thereof.

The glove will of course cover any jewelry which the users may have on her hand and will also encase and envelope any jagged fingernails or rough skin whereby fine fabric such as nylon hosiery or other fine materials may be handled when the user is wearing the glove, without danger of ripping, tearing, snagging or running the hosiery or other materials. It will also be appreciated that the glove may be worn when washing delicate items such as hose, sweaters or the like or may also be used to protect the hands when applying medical or beautifying creams, ointments or the like, particularly since the glove is of universal shape and form and may be readily donned.

Since, in any contemplated use of the glove, it is desirable that the user have maximum dexterity of her fingers, notwithstanding the presence of the glove, the glove has been especially designed to permit maximum movement of the thumb and fingers and is particularly fabricated, designed and constructed to permit maximum relative movement of the thumb and index finger of the user, which fingers are primarily used by a woman when putting on or taking off panty hose.

Figure 2:
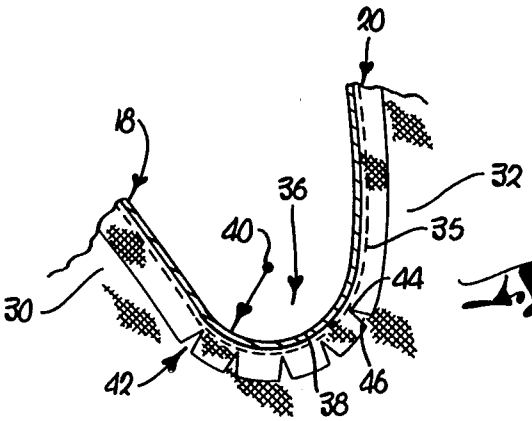
FIG. 2 is an enlarged fragmentary view showing the radius and relief cuts at the junction between the first section and the second section taken from the inside of the glove.
Figure 1:
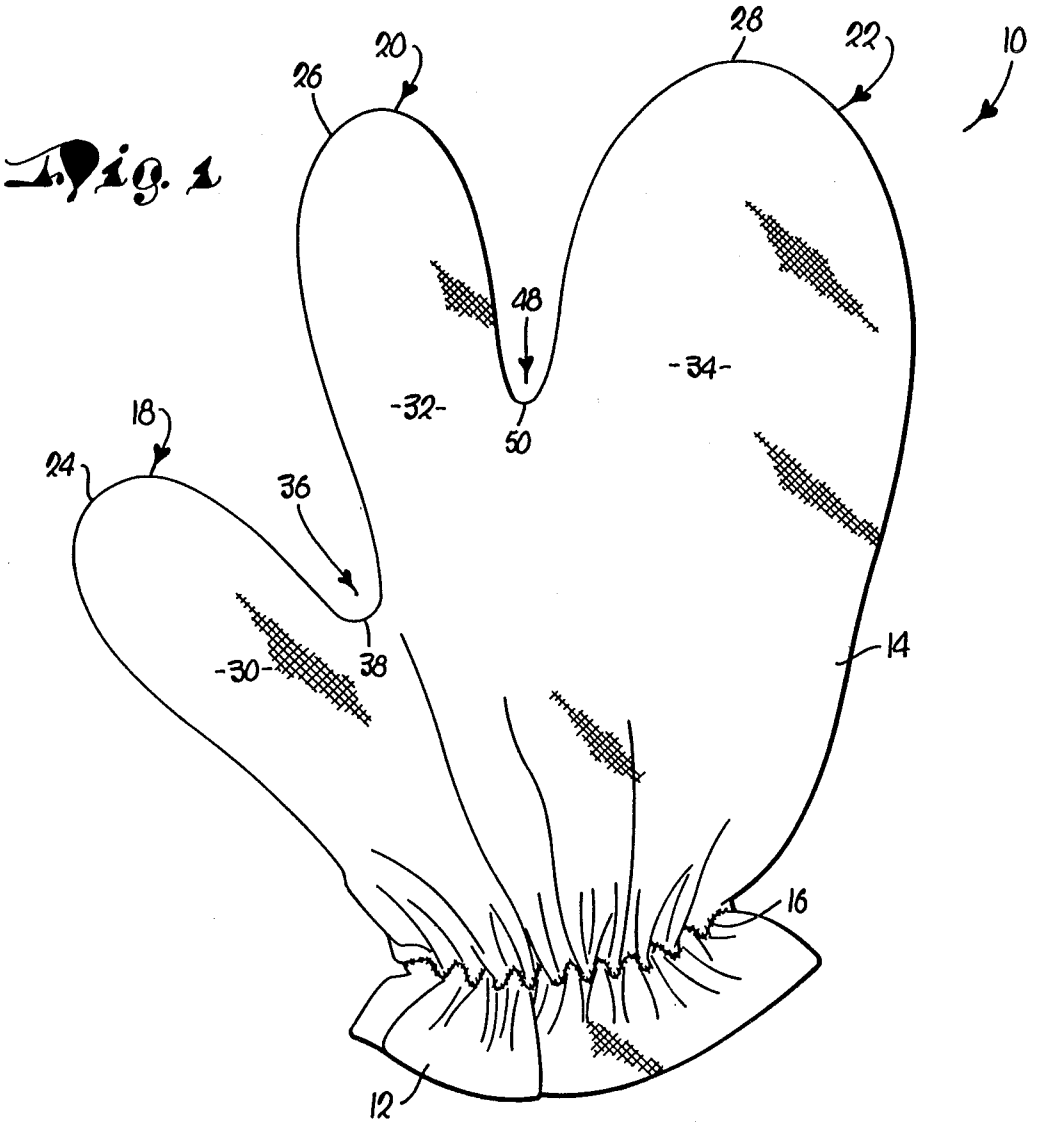
FIG. 1 is an elevational view of the outside of the glove showing one face thereof.

To this end, there is provided, at the base end junction 36 beteen the first section 18 and the second section 20, a sweeping radius, as at 38, such sweeping radius being shown, in enlarged condition, in FIG. 2 of the drawing.

The radius is calculated from a point 40, as illustrated on the drawing, and in the embodiment chosen for illustration, the radius between the first section 18 and the second section 20 is on the order of ¼" to ½" whereby to insure that there is maximum relative movement permitted between the section 18 which envelopes the thumb and the section 20 which envelopes the index finger since these two digits are those most normally used in pulling on panty hose.

To yet further permit maximum relative movement between the sections 18 and 20, and to provide comfort, and further relieve the stress which is exerted thereon during such a maximum movement, the junction 36, at radius 38, is provided with a plurality of relief cuts such as 42 which each radiate outwardly from the radius defined at 38, in the manner shown in FIG. 2. Each relief cut may be straight line or V-shaped in configuration and when V-shaped as illustrated presents an apex end 44 which is adjacent or toward the corresponding radius 38 and an open end 46 which extends away from the radius 38 at the junction 36 between sections 18 and 20.

Similar construction is presented at the junction 48 between second section 20 and third section 22 in that there is presented a radius 50 whereby to permit maximum relative movement between the juxtaposed sections 20 and 22 when the glove 10 is on the hand of the user.

Radius 50 is smaller than radius 38 and has been found to preferably be on the order of ⅛" to ¼" measured from a point such as 52 illustrated in FIG. 3.

The junction 48 is also provided, adjacent the radius 50, with a plurality of relief cuts 54 which radiate outwardly from the radius 50 as illustrated, each of the cuts having an apex end 56 adjacent the radius 50 and an open end 58 spaced from the radius 50 at the junction 48.

In both the radius 38 and the radius 50, it has been found that three to five relief cuts such as 42 and 54 are desirable to enhance the maximum movement which is initially accomplished by the presentation of the corresponding radii 38 and 50.

It will be appreciated that the radius 38 is greater than the radius 50 whereby the greatest movement is permitted between section 18 and section 20, it having been found that this enhanced movement is necessary in order to permit the most effective utilization of the glove 10 in putting on and taking off panty hose and yet preventing snagging, tearing, ripping or running of the hosiery while positioning the same on the body of the user and simultaneously positioning the seams in the desired position.

Thus, there is presented a glove 10 which may be fabricated from a relatively inexpensive material, such as 40 to 70 denier nylon and may be readily fabricated by merely sewing or possibly heat sealing two identical halves or tranks together to present the finished glove.

If it is desired to fabricate a glove which may be utilized for the aforementioned purpose but which would contain less material, it will be appreciated that the metracarpal portion 14 may be abbreviated whereby to terminate approximately midway of the metacarpal area of the user, thereby eliminating the lower area of metacarpal portion 14, the elastic 16 and the gauntlet portion 12. This would permit fabrication of a glove from even less material and at a lower cost and would yet present the essential elements desirable in a glove to be utilized for the purpose hereinabove described.

Also, it is contemplated that the glove could be fabricated in the usual five finger configuration, rather than in three segments, as illustrated. In such a five finger version the material woul be the same and there would likewise be a large radius between the finger portins of the glove and cuts in connection with such radii, as in the embodiment chosen for illustration.

We claim:

1. A hand covering in the nature of a glove comprising:

a plurality of interconnected sections for collectively enveloping the thumb and four fingers of a user of the glove, there being a first section enveloping the thumb, a second section enveloping the index finger and a third section enveloping the middle, ring and little fingers, each section having a tip end and a base end, the first section having a junction at its base end with the second section, the second section having a junction at its base end with the third section, there being a sweeping radius formed at each of said junctions whereby each of the first and second sections may be allowed maximum movement in using the glove;

the radius at the junction between the first section and the second section being greater than the radius at the junction between the second section and the third section, the radius at the junction between the first section and the second section being from one-fourth inch to one-half inch and the radius at the junction between the second section and the third section being from one-eighth inch to one-fourth inch;

the glove being fabricated from a plurality of glove portions joined together at a seam along their mating edges;

a plurality of spaced relief cuts at each of said junctions disposed in the vicinity of said means and each of the radii;

the glove being fabricated in its entirety from nylon material of from 40 to 70 denier in fineness.

2. A glove for protecting hosiery and other delicate products comprising:

a gauntlet portion fabricated of nylon material of 40 to 70 denier in fineness for enveloping at least one of the lower portion of the hand and the wrist of a user;

a metacarpal portion fabricated of nylon material 40 to 70 denier in fineness for enveloping the palm of the hand of a user;

a band interconnecting the gauntlet portion and the metacarpal portion;

a plurality of interconnected sections fabricated of nylon material of 40 to 70 denier in fineness connected to said metacarpal portion for collectively enveloping the thumb and four fingers of a user of the glove, there being a first section enveloping the thumb, a second section enveloping the index finger and a third section enveloping the middle, ring and little fingers, each section having a tip end and a base end, the first section having a junction at its base end with the second section, the second section having a junction at its base end with the third section, there being a sweeping radius formed at each of said junctions whereby each of the first and second sections may be allowed maximum movement in using the glove;

the radius at the junction between the first section and the second section being greater than the radius at the junction between the second section and the third section, the radius at the junction between the first section and the second section being from one-fourth inch to one-half inch and the radius at the junction between the second section and the third section being from one-eighth inch to one-fourth inch;

the glove being fabricated from a plurality of glove portions joined together at a seam along their mating edges;

a plurality of spaced relief cuts at each of said junctions disposed in the vicinity of said seam and each of the radii.

3. A glove for protecting hosiery and other delicate products comprising:

a metacarpal portion fabricated of nylon material of 40 to 70 denier in fineness for enveloping only a portion of the palm of the hand of a user.

a plurality of interconnected sections coupled to said metacarpal section and fabricated of nylon material of 40 to 70 denier in fineness for collectively enveloping the thumb and four fingers of a user of the glove, there being a first section enveloping the thumb, a second section enveloping the index finger and a third section enveloping the middle, ring and little fingers, each section having a tip end and a base end, the first section having a junction at its base end with the second section, the second section having a junction at its base end with the third section, there being a sweeping radius formed at each of said junctions whereby each of the first and second sections may be allowed maximum movement in using the glove;

the radius at the junction between the first section and the second section being greater than the radius at the junction between the second section and the third section, the radius at the junction between the first section and the second section being from one-fourth inch to one-half inch and the radius at the junction between the second section and the third section being from one-eighth inch to one-fourth inch;

the glove being fabricated from a plurality of glove portions joined together at a seam along their mating edges;

a plurality of spaced relief cuts at each of said junctions disposed in the vicinity of said seam and each of the radii.

* * * * *